US006901033B2

(12) United States Patent
Ito

(10) Patent No.: US 6,901,033 B2
(45) Date of Patent: May 31, 2005

(54) ELECTRONIC TIMEPIECE

(75) Inventor: Tokiko Ito, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 429 days.

(21) Appl. No.: 10/128,109

(22) Filed: Apr. 23, 2002

(65) Prior Publication Data

US 2002/0167867 A1 Nov. 14, 2002

(30) Foreign Application Priority Data

Apr. 24, 2001 (JP) ..... 2001-125771
Feb. 27, 2002 (JP) ..... 2002-052105

(51) Int. Cl.[7] ..... G04B 1/00
(52) U.S. Cl. ..... 368/204; 368/88; 368/76; 368/205
(58) Field of Search ..... 368/76, 88, 155, 368/223, 203–205, 220

(56) References Cited

U.S. PATENT DOCUMENTS 4,392,748 A * 7/1983 Yoshino ..... 368/88
4,437,768 A * 3/1984 Miyasaka ..... 368/88
4,477,195 A * 10/1984 Saitoh et al. ..... 368/88
4,478,524 A * 10/1984 Saitoh et al. ..... 368/204
4,496,246 A * 1/1985 Ota et al. ..... 368/88
4,783,772 A * 11/1988 Umemoto et al. ..... 368/11

FOREIGN PATENT DOCUMENTS

JP 7-72266 3/1995
JP 2001-99960 4/2001

* cited by examiner

*Primary Examiner*—Kamand Cuneo
*Assistant Examiner*—Jeanne-Marguerite Goodwin
(74) *Attorney, Agent, or Firm*—Rosalio Haro

(57) ABSTRACT

In an electronic timepiece 1 having a main plate 10, a drive circuit 36, a stepper motor 33, a train wheel, a dial plate, a power supply 15, and an insulation sheet 12, the insulation sheet 12 covers at least the vicinity of the power supply 15 as well functioning as a guide to position an hour wheel 11 in an axial direction. Since the insulation sheet 12 has a predetermined size, it is neither dislocated nor removed when it is attached, whereby the insulation sheet 12 can reliably perform insulation, and an assembly property is improved thereby. Further, the insulation sheet 12 can achieve the dual roles of insulation and assembly guide, which can reduce cost and ease an assembly job.

13 Claims, 14 Drawing Sheets

CROSS SECTION ALONG LINE A-A

CROSS SECTION ALOMG LINE B-B

[FIG. 1]
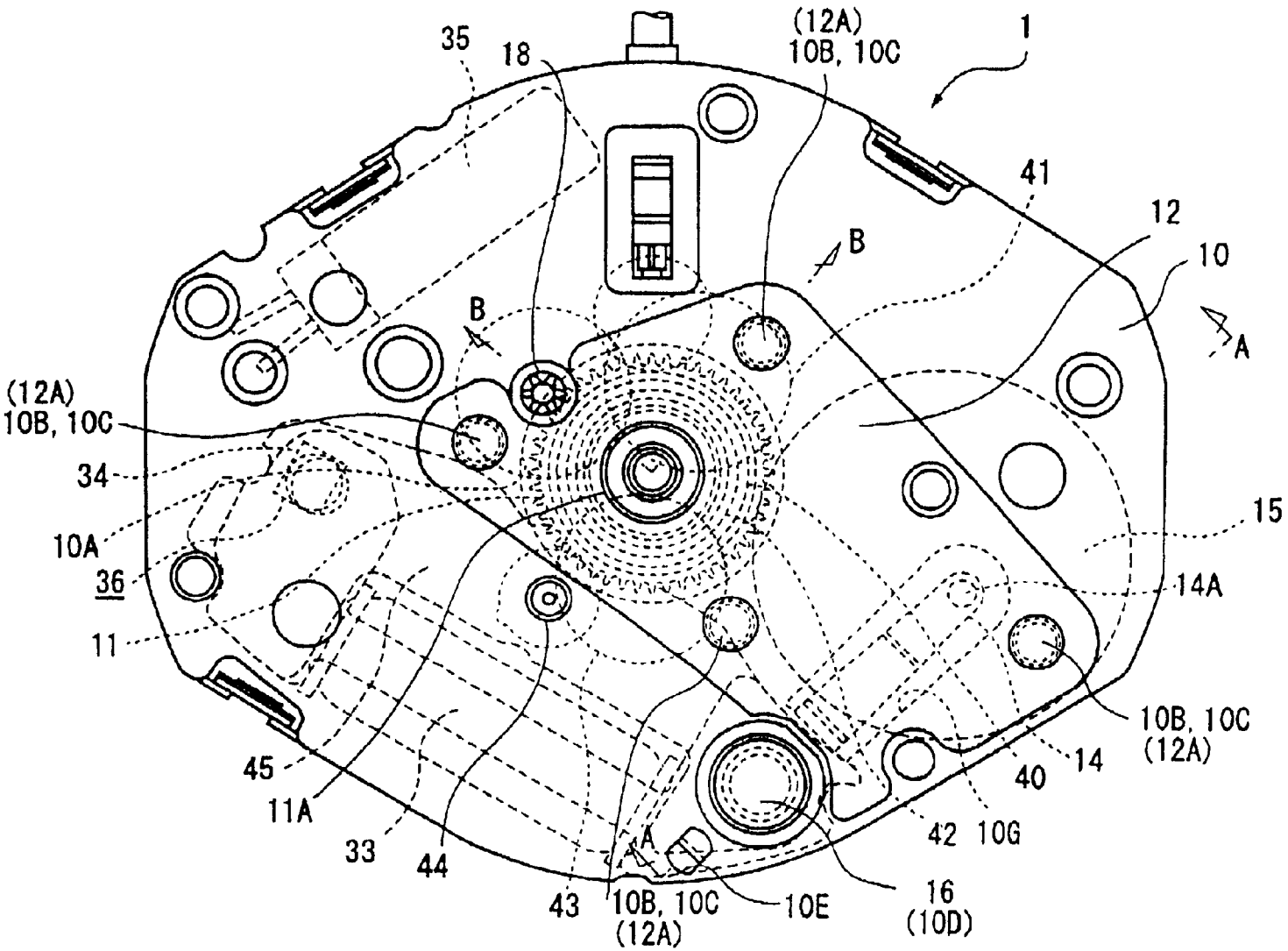

[FIG. 2]
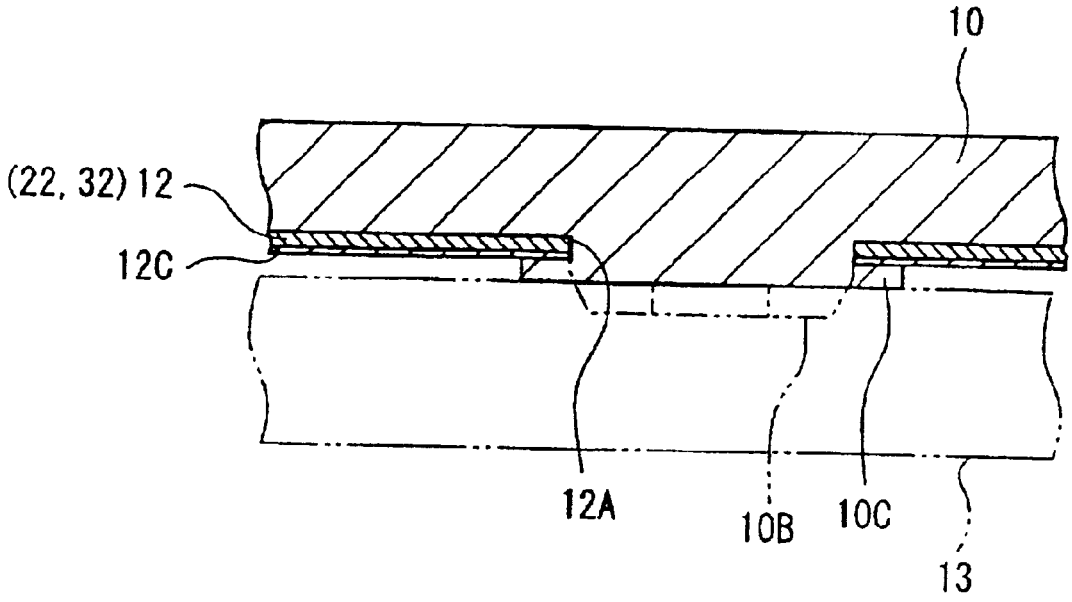

[FIG. 3]
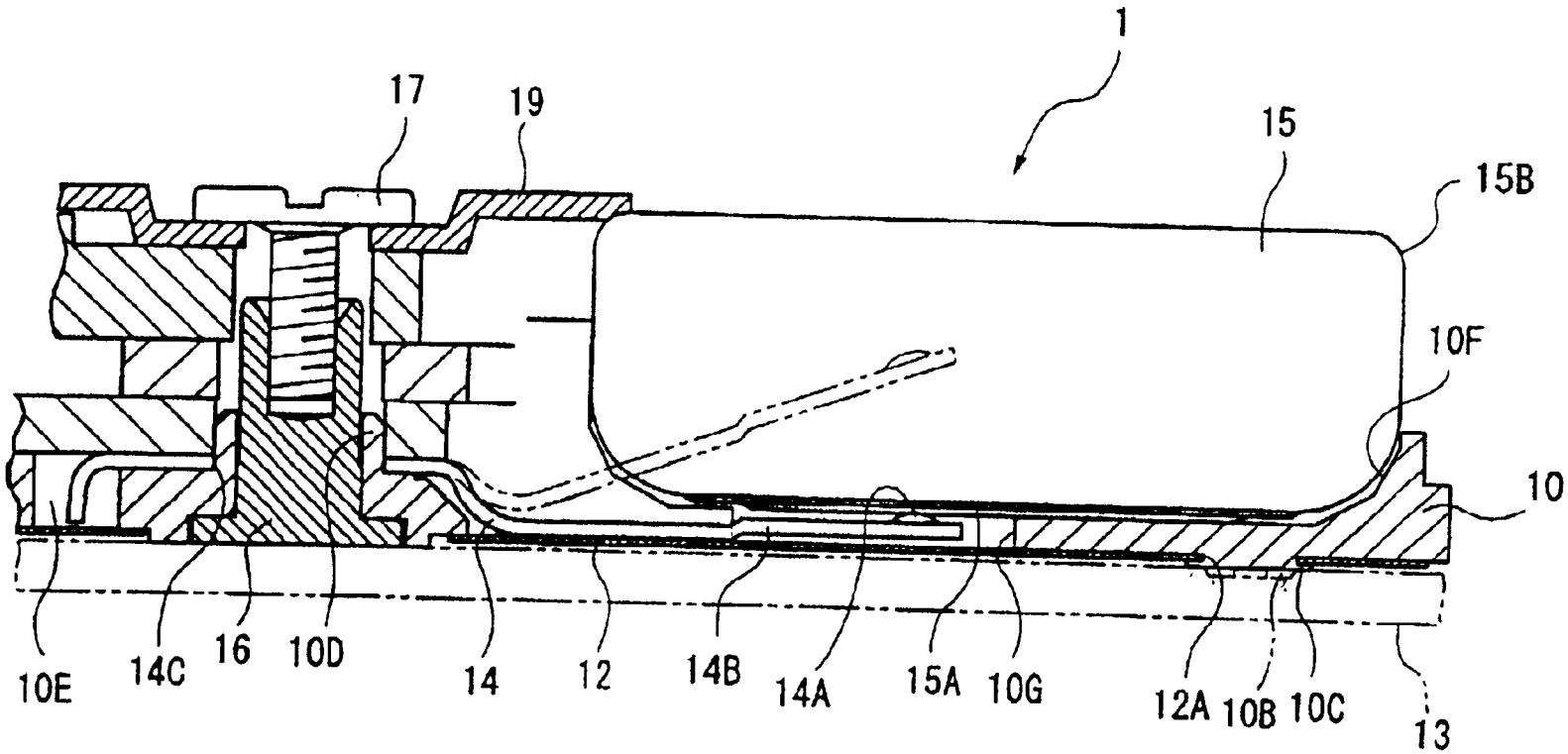
CROSS SECTION ALONG LINE A-A

[FIG. 4]
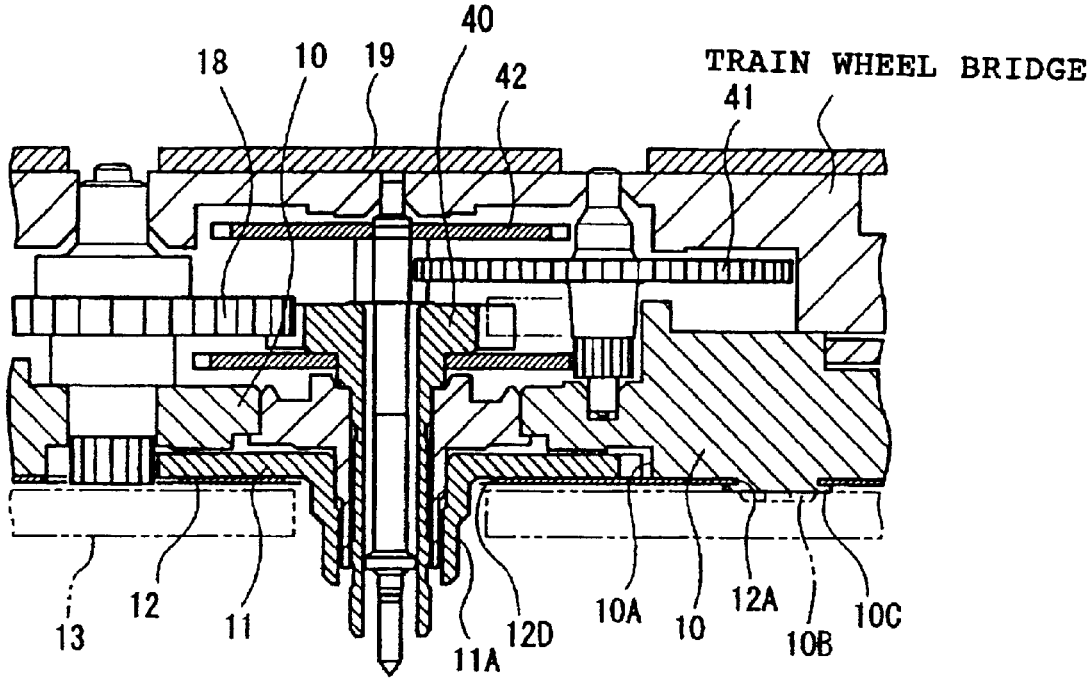
CROSS SECTION ALOMG LINE B-B

[FIG. 5]
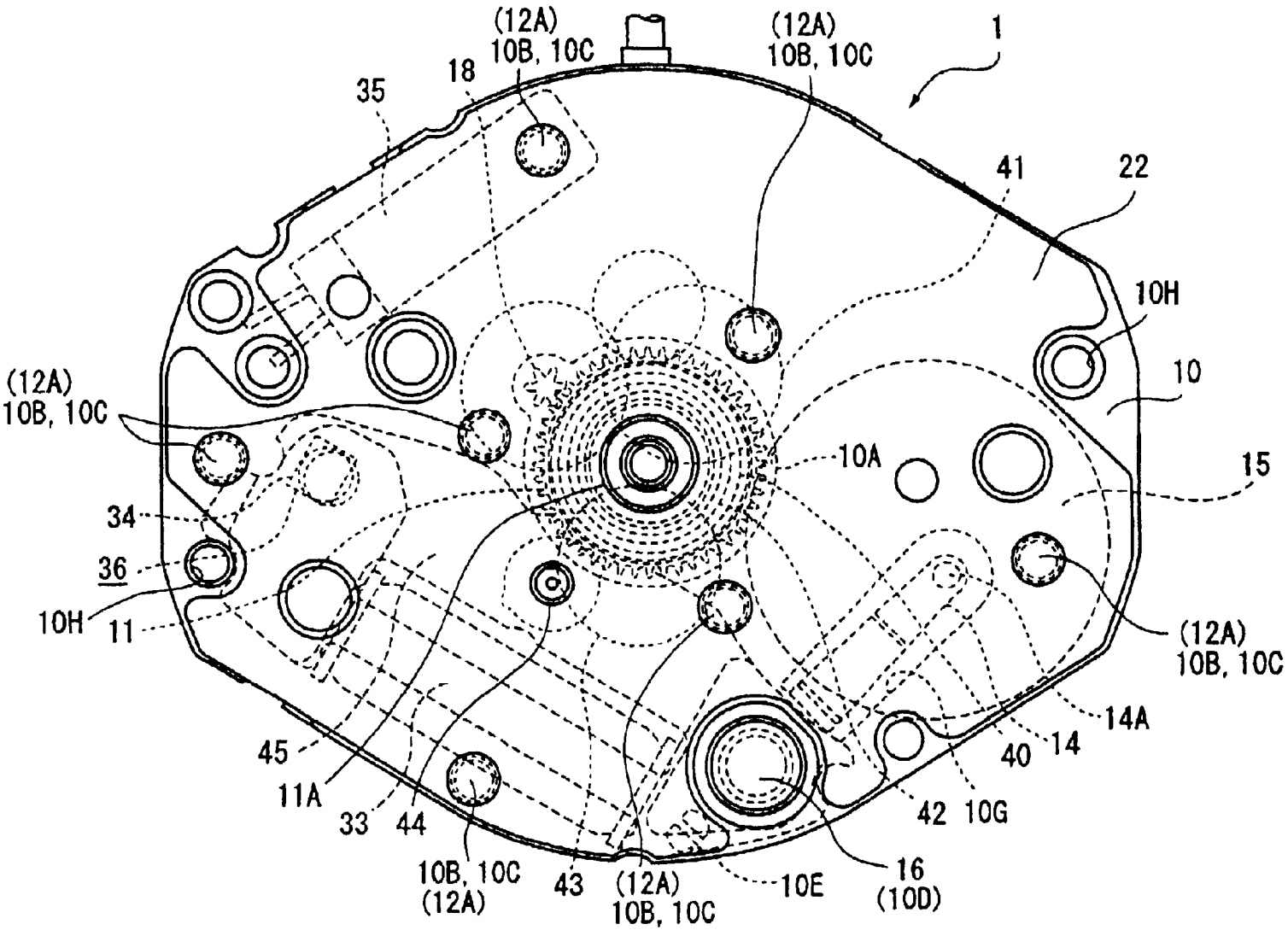

[FIG. 6]
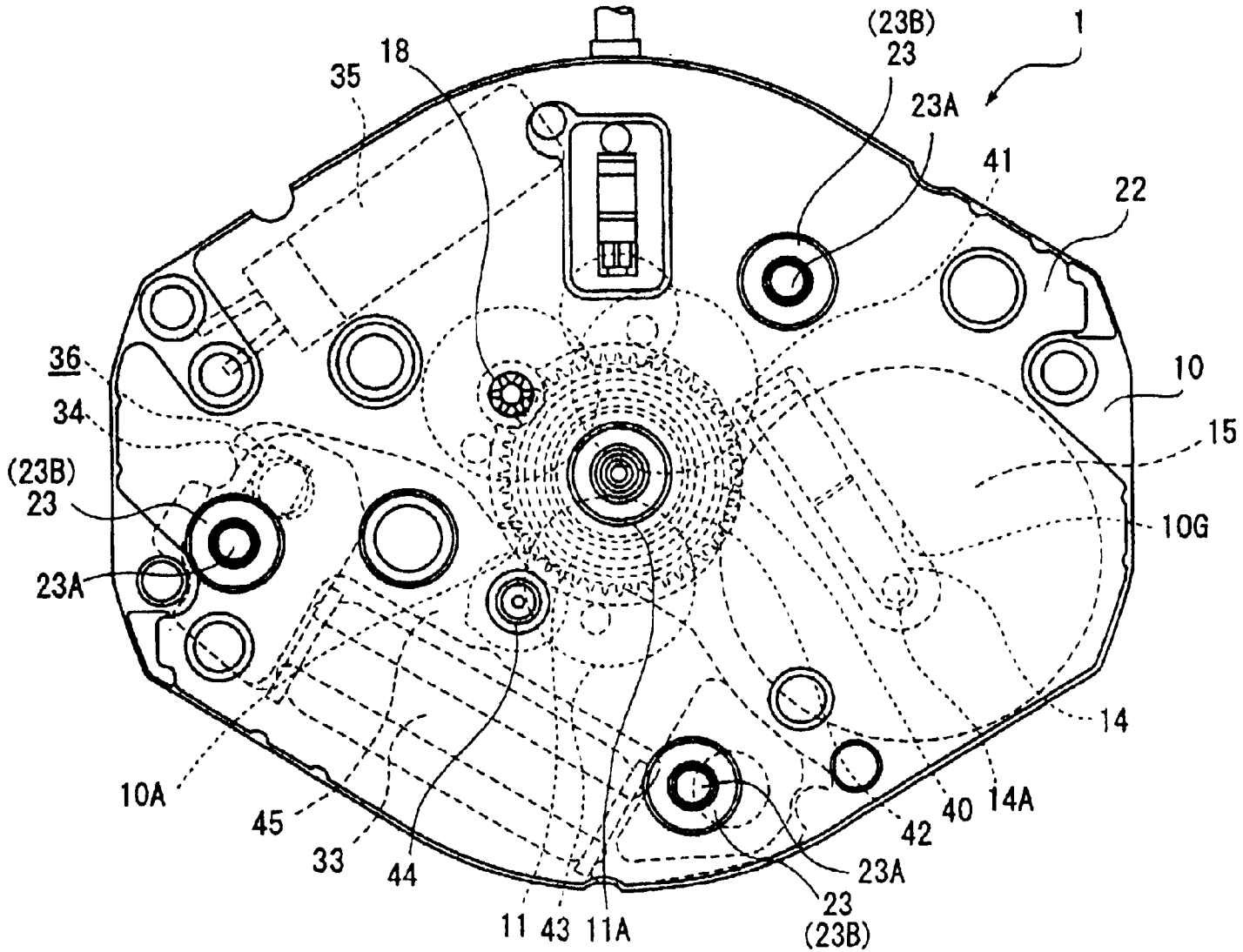

[FIG. 7]
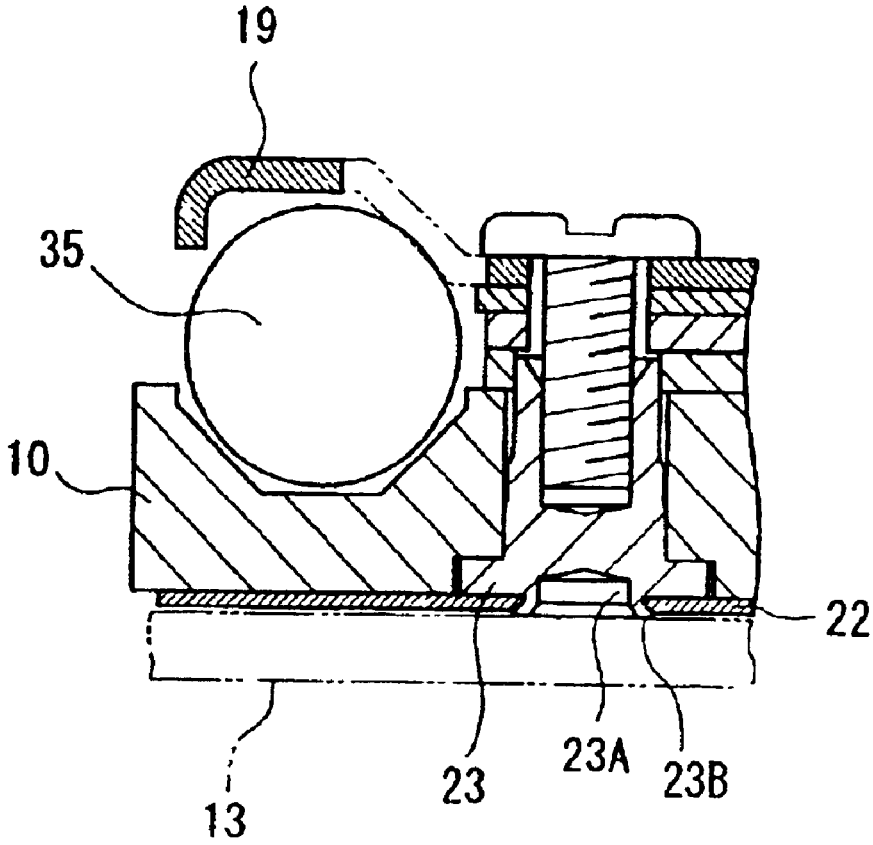

[FIG. 8]
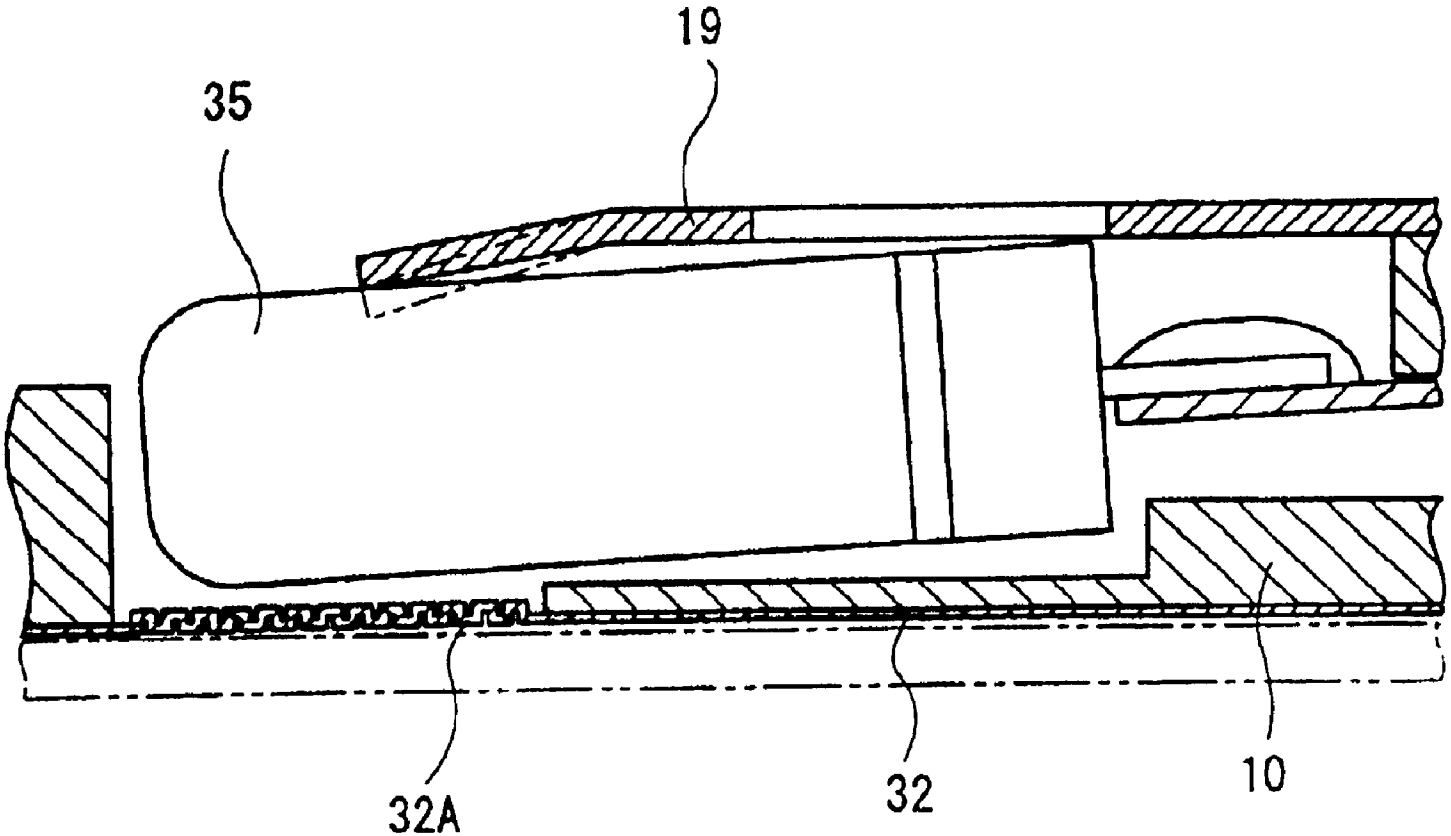

[FIG.9]
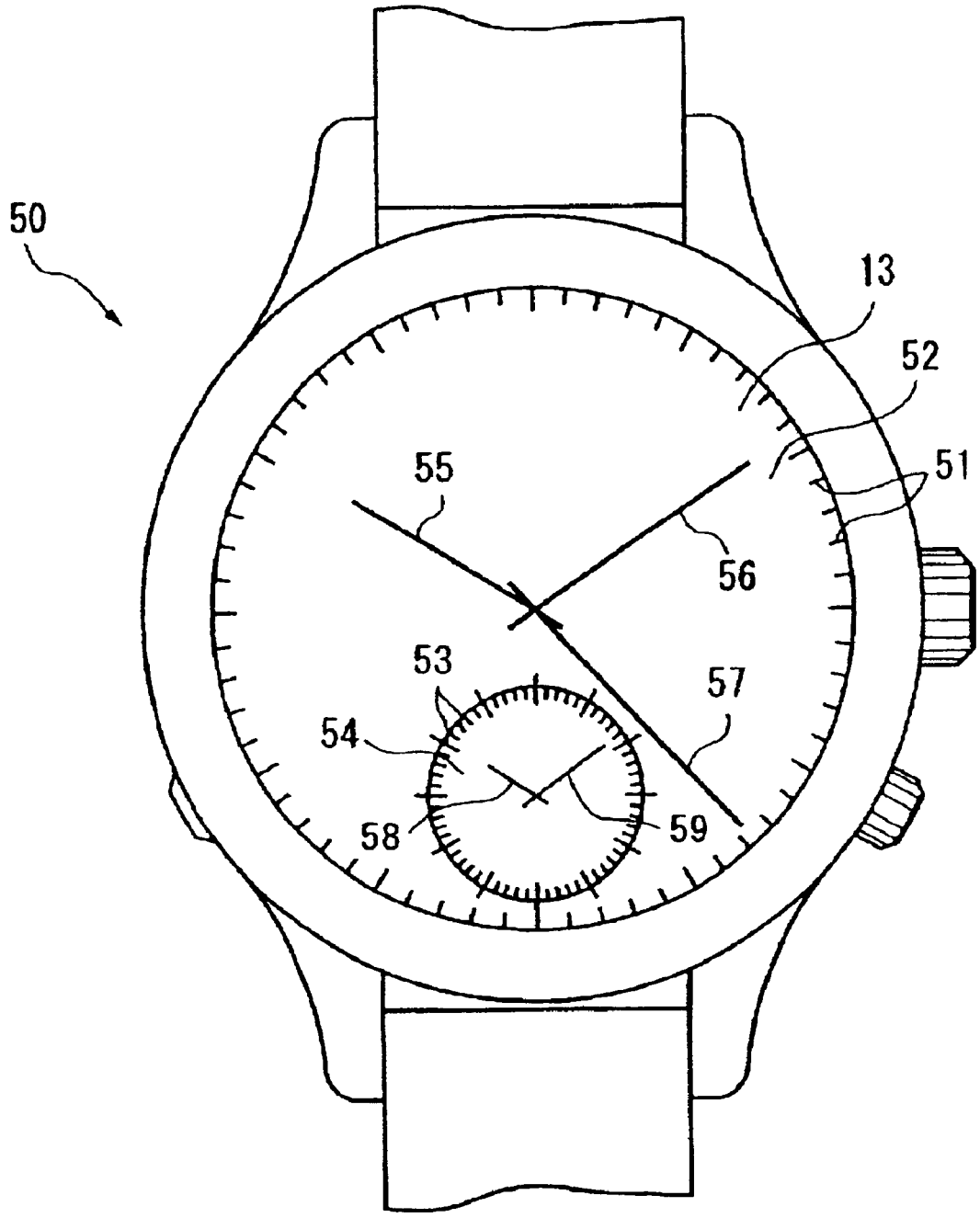

[FIG. 10]
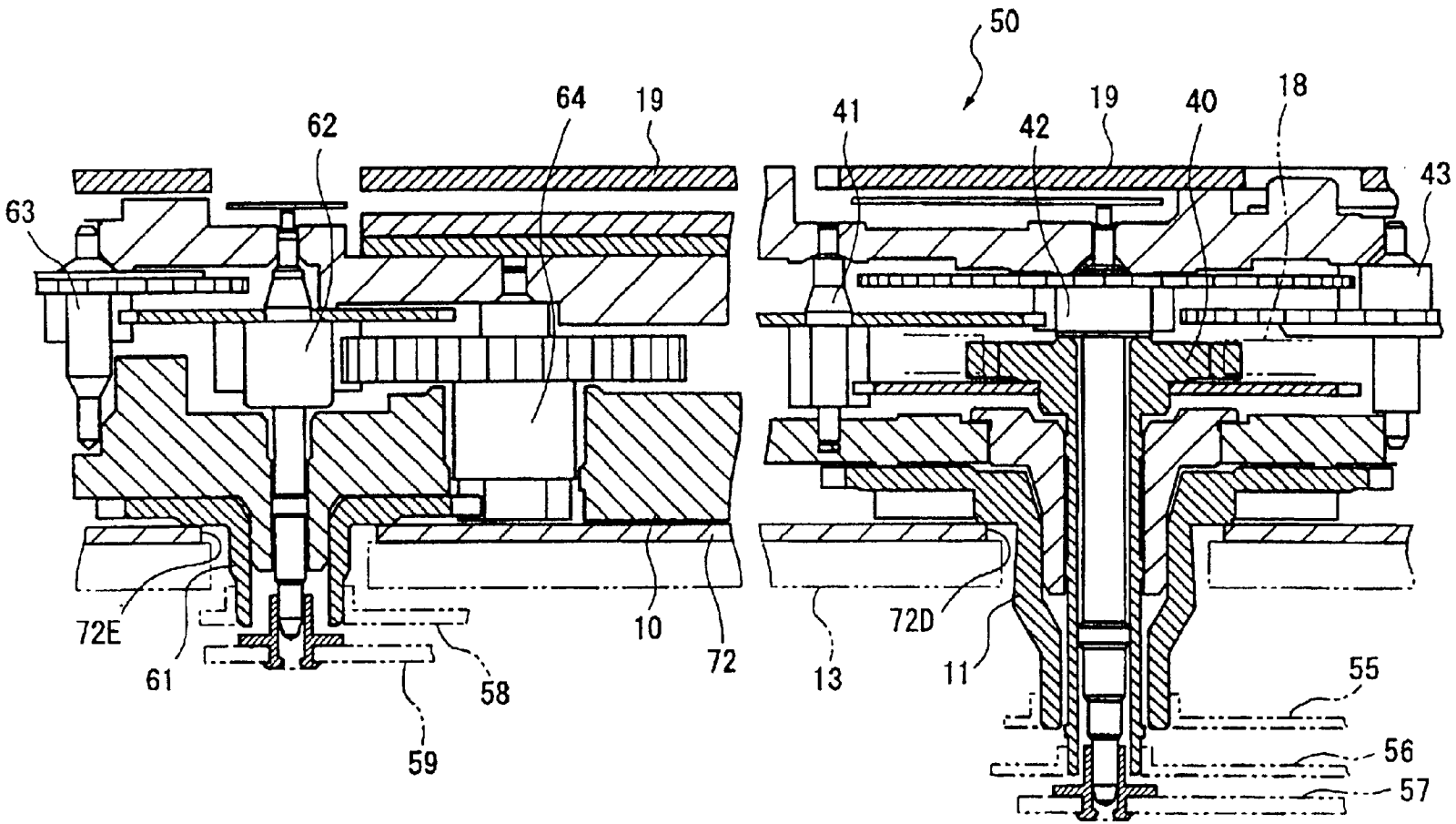

[FIG. 11]
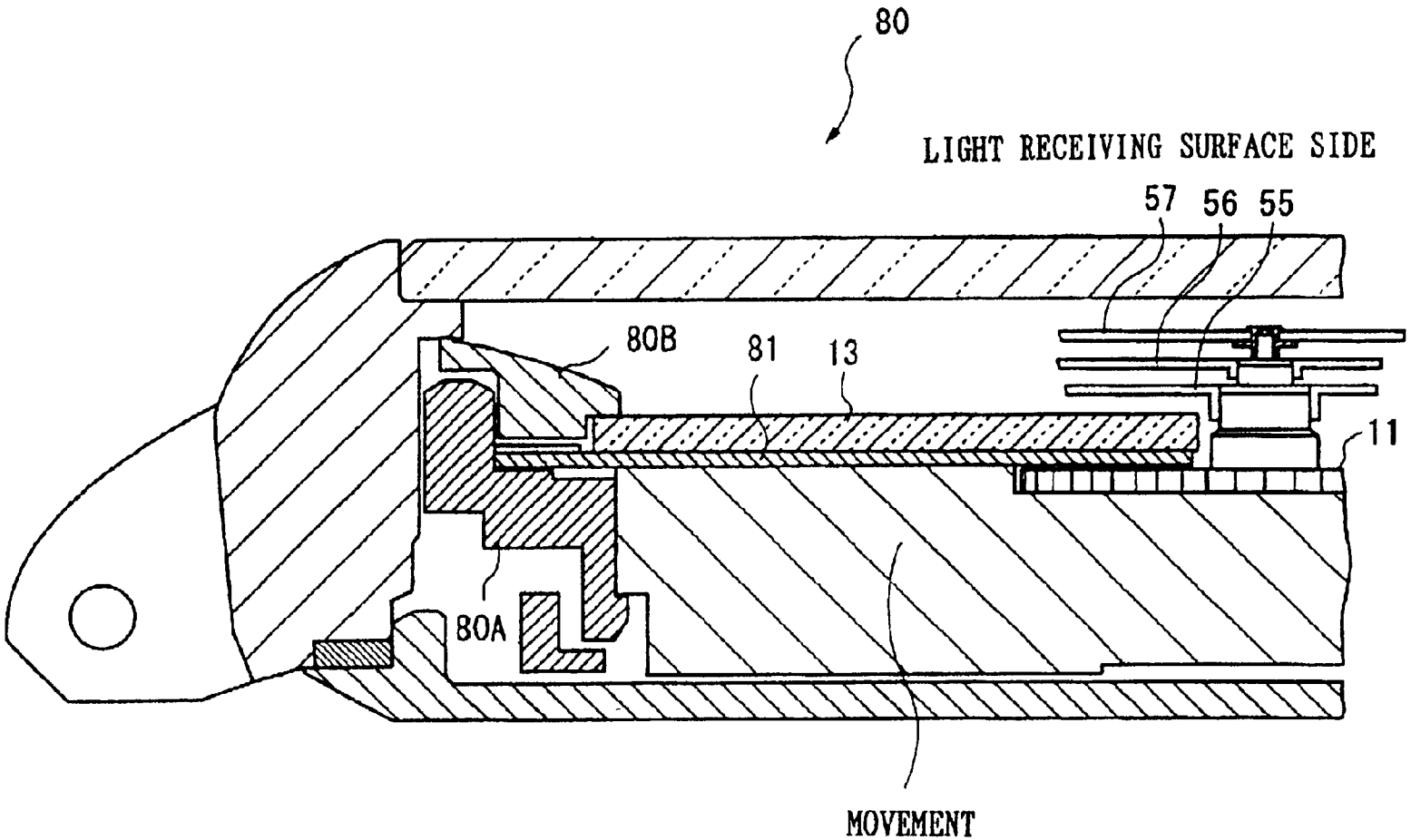

[FIG. 12]
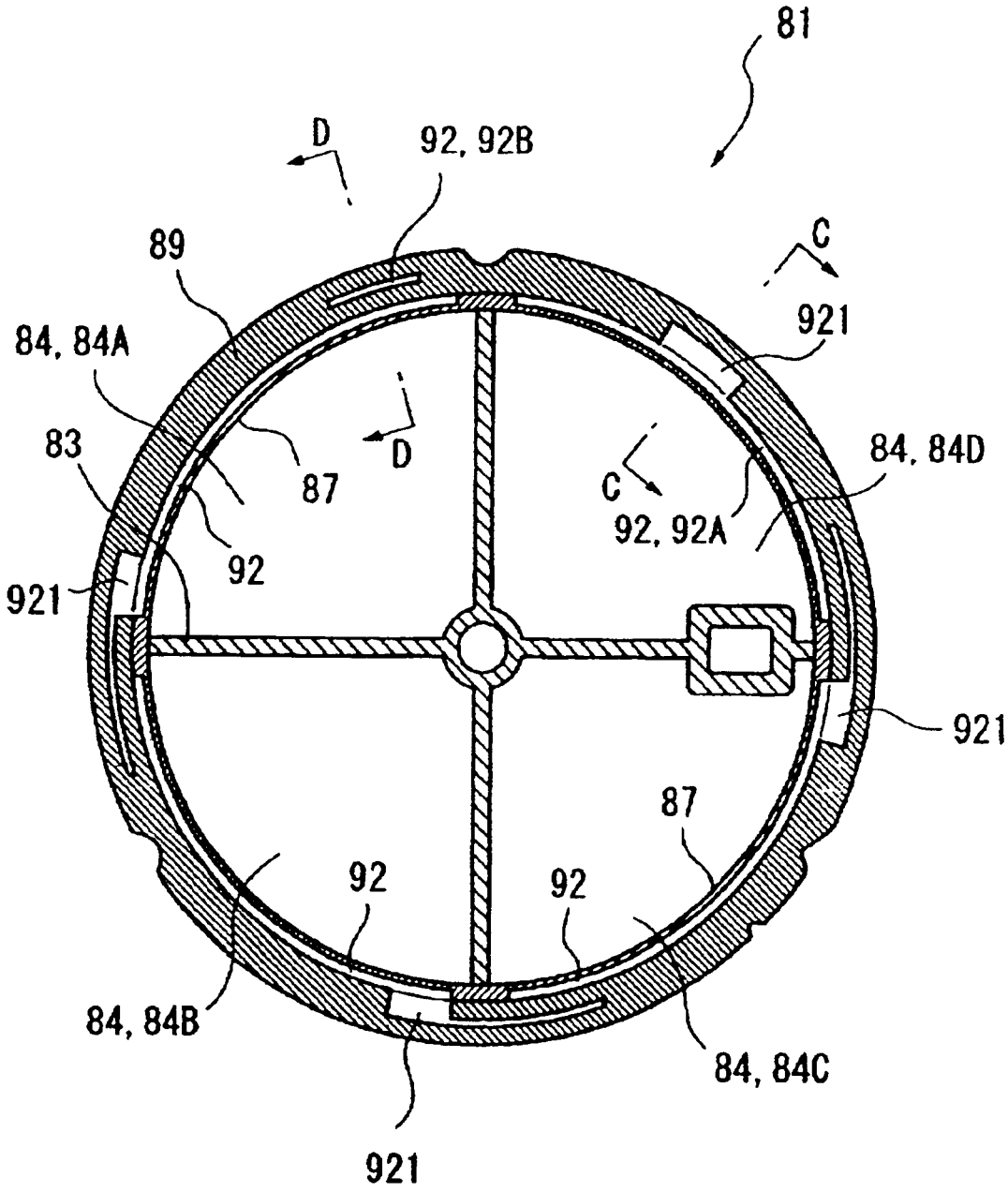

[FIG. 13]
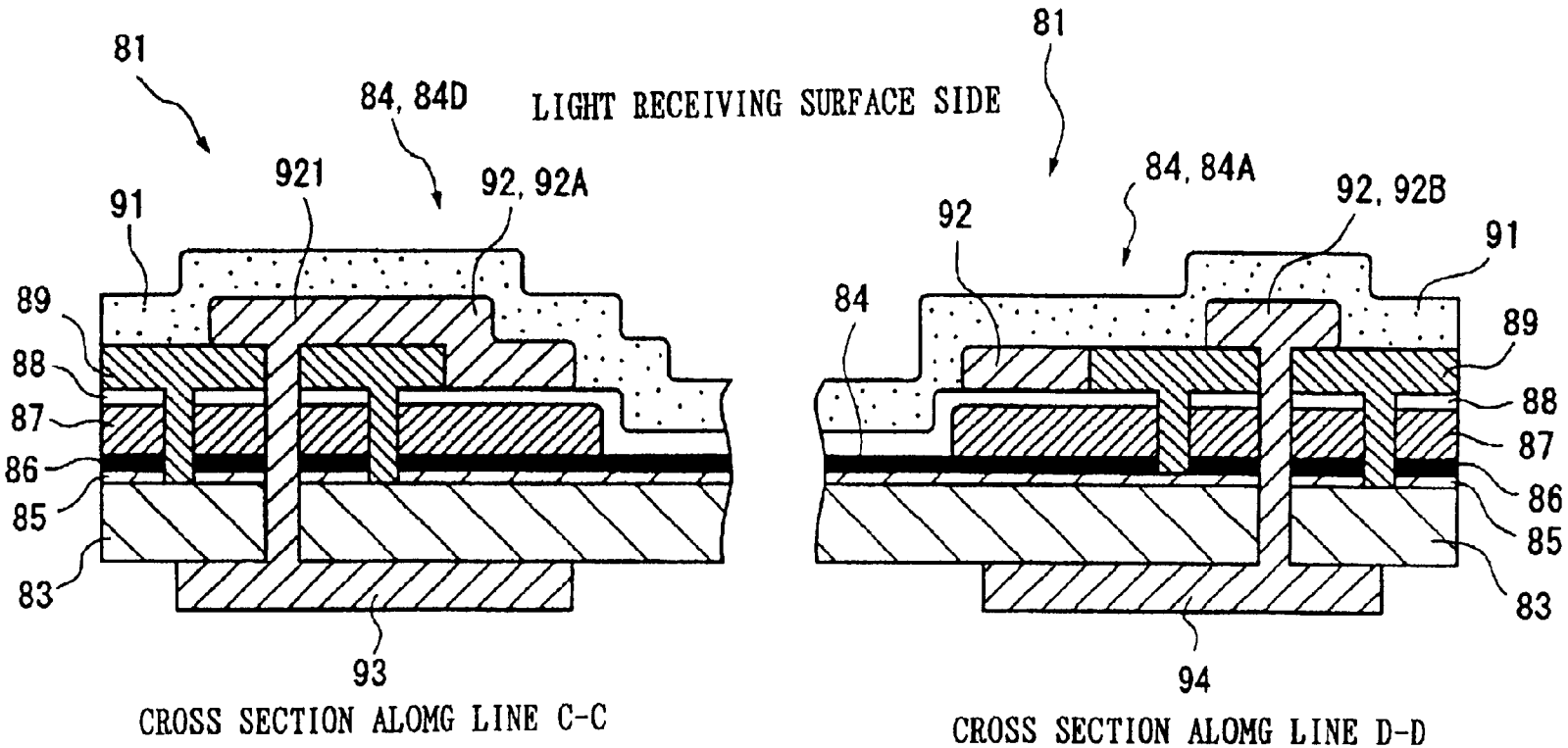

[FIG. 14]
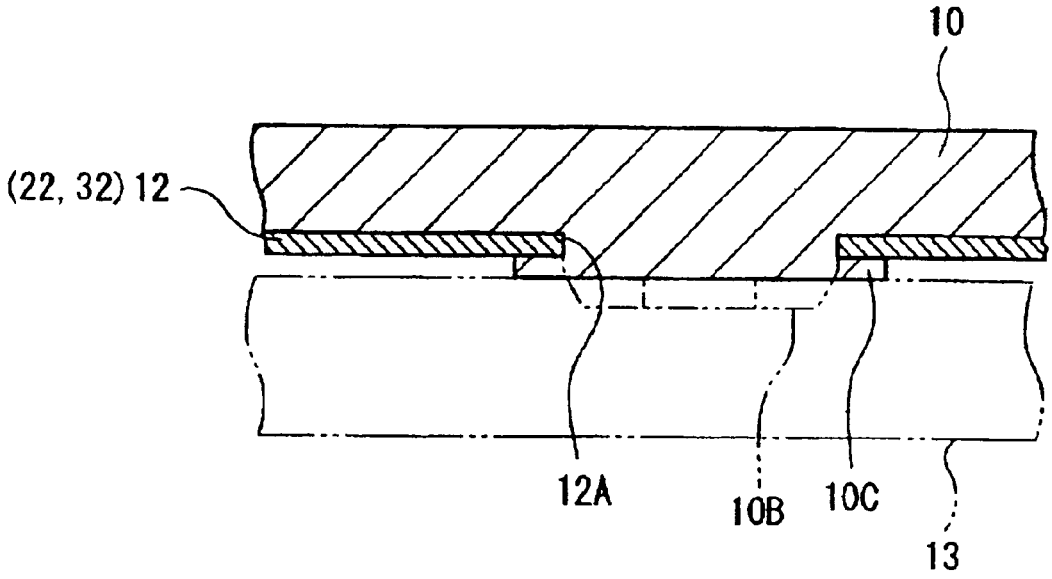

ELECTRONIC TIMEPIECE

BACKGROUND OF THE INVENTION

1. Field of the Invention

The present invention relates to an electronic timepiece such as a quartz timepiece, and the like.

2. Description of the Related Art

There are known conventional electronic timepieces, such as quartz timepieces, that use an electronic circuit to generate accurate, periodic electrical signals measure the passage of time and to display the time.

Similarly to mechanical wristwatches in wristwatches that use these electronic timepieces, it is desirable to make a timepiece movement small and thin in size. However, the size of a power supply is determined from a relationship between the power consumption (usually in terms of electric current) of a timepiece and the capacity of the power supply to meet the timepiece's power requirements while satisfying an expected life span for the power supply. Accordingly at present, the thickness of the timepiece movement of an electronic timepiece is dominated by the thickness of the power supply unit.

In electronic timepieces, the power supply is used as a drive source for driving the electrical components. This power supply is typically arranged such that a positive pole is grounded to the case side of the timepiece and a negative pole is in contact with an electrode disposed as a power rail to the electrical components of the movement.

One surface of a negative power rail terminal, which is the electrode disposed as a power rail to the electrical components of the movement, is in contact with the negative pole of the power supply as described above, and the other surface of the negative power rail terminal is disposed in facing a dial plate. When the dial plate comes into contact with the negative power terminal, an electric short-circuit between the positive and negative poles of the power supply is established because the dial plate is formed of a metal material and is in contact with the case. As a result, drain of power is intensively consumed from the power supply, and the power current is diverted away from the electrical components giving rise to a problem that the hands of the timepiece, and other electronically controlled components, are stopped. To cope with this problem, an insulation sheet is interposed between the above-described negative power rail terminal and the dial plate.

As shown in (1) Japanese Unexamined Utility Model Publication Nos. 63-3059 and 58-71977, the insulating structure of the negative power rail terminal is arranged such that a power supply is accommodated in a power-supply-accommodation recess formed in a main plate acting as the base frame of a timepiece and an insulation-sheet-accommodation recess is further formed in the power-supply-accommodation recess. Slits or pins are disposed around the outer periphery of the insulation-sheet-accommodation recess. To attach a thin insulation sheet, it is positioned by the slits or the pins as well as accommodated in the insulation-sheet-accommodation recess so that it exactly fits therein in a surface direction, thereby electric short-circuit between the negative power rail terminal and the dial plate or an hour wheel presser, each composed of a metal material, is prevented.

Further, an hour wheel presser is used to provide a predetermined play (movable back-lush in an axial direction) with an hour wheel acting as a time-display wheel disposed in the movement.

As disclosed in (2) Japanese Unexamined Utility Model Publication No. 04-029891, an hour wheel presser guides an hour wheel in its axial direction. According to this publication, the hour wheel presser is fixed on the upper surface of a movement by a bonding or screw system, or a press-fit engaging system. Further, a dial plate is disposed on the upper surface of the hour wheel presser, and the insulation sheet is interposed between the hour wheel presser and the dial plate.

In the insulating structure of (1), however, the insulation sheet is thin. Thus, a problem arises in that it is difficult to attach the insulation sheet to the slits or the pins to position it, and the assembling property thereof is bad. In particular, since the insulation sheet is thin and does not have rigidity, even if it is attached to the slits or the like while it is being assembled to the movement, there is a possibility that it may be removed or dislocated by a slight shock, and the like. When a power supply is assembled in this state, a problem arises in that electric short-circuit is caused by the contact of a member set to the negative potential of the power supply with a member set to the positive potential of the power supply and the operation of hands is stopped.

Further, when the hour wheel presser is fixed by the boding system in (2), a problem arises in that a bonding agent is applied in an excessively large amount and protrudes to the periphery thereof and that an assembly time is increased because a curing time of the bonding agent is necessary. Further, since hour wheel presser is fixed by the application of the boding agent, the thickness of the applied bonding agent is dispersed, which results in an inevitable increase in the dispersion of plays of hour wheels. Further, since the insulation sheet is fixed by the application of the bonding agent, when the insulation sheet is picked up and pressed to a predetermined position, it is dislocated therefrom or deformed, thereby the outside appearance of the movement is defaced.

When the hour wheel presser is fixed by the screw system, two or more screws are necessary because it cannot be fixed by one screw. Thus, the number of screws is increased as well as a troublesome job for assembling the screw pins to a main plate is additionally needed, thereby an assembly job becomes complex and cost is increased thereby.

Further, when the hour wheel presser is fixed by the press-fit engaging system, the number of parts is reduced as compared with the screw system and workability in assembly is improved. However, a synthetic resin portion is cut by the hour wheel presser composed of a metal material, and synthetic resin powder having been cut is deposited on a train wheel portion. As a result, a problem arises in that the operation of the hands is delayed or stopped.

Further, since two kinds of parts, that is, a dedicated hour wheel presser and a dedicated insulation sheet are used conventionally, the number of parts is increased as well as the production and management of them are troublesome and cost is increased.

OBJECT OF THE INVENTION

It is an object of the present invention to provide an electronic timepiece that can insulate a power supply side from other conductive parts and guide an hour wheel (time-display wheel) by one kind of a member, make an assembly job easy and reduce cost.

SUMMARY OF THE INVENTION

In an electronic timepiece according to the present invention having a base frame composed of a synthetic resin, a drive conversion unit driven in rotation by electric power, a driving-controlled circuit for controlling the drive conversion unit, a power supply for supplying electric power to the driving-controlled circuit, a time-display member disposed to the outside of the base frame in confrontation therewith, and a time-display wheel rotated by the drive in rotation of the drive conversion unit and interposed between the base frame and the time-display member, the electronic timepiece is characterized in that one of the positive pole and the negative pole of the power supply is set to a power supply potential that is set as the power supply voltage of the driving-controlled circuit as well as the other of them is grounded and set to a ground potential acting as the reference of a voltage, and a plane insulation member is provided to prevent electric short-circuit between an electrode in contact with a pole set to the power supply potential and a portion set to the ground potential and has an area for covering at least the electrode and the time-display wheel as well as has a hole through which the shaft of the time-display wheel is passed.

According to this invention, the electrodes such as a power supply negative terminal, and the like and the time-display wheel are covered with the insulation member as well as the shaft of the time-display wheel, for example, an hour wheel is inserted into the hole of the insulation member to thereby guide the hour wheel in an axial direction. Accordingly, the insulation member has the predetermined area, and thus when the insulation member is assembled, it can be attached only by being fitted on the shaft of the hour wheel, thereby an assembly property can be improved.

Further, there is not a possibility that the insulation member is dislocated or removed in the vicinity of the electrodes because it can be fixed in such a manner that it is attached by being fitted on the shaft of the hour wheel. As a result, electric short-circuit caused by the contact of the member set to the negative potential of the power supply with the member set to the negative potential of the power supply can be prevented, thereby they can be reliably insulated.

Further, since insulation and guide of the hour wheel can be performed by the insulation member, the number of parts can be reduced and a parts cost can be decreased. As a result, cost can be reduced as well as an assembly job can be eased by the decrease in the number of parts, which can reduce a cycle time in an assembly line.

Further, the insulation member has the area that covers at least the portion set to the ground potential and the hour wheel and is set to a minimum necessary size. Thus, the parts cost can be reduced by the reduction of a material cost and the structure of a press metal mold can be simplified.

The insulation member can be formed of a synthetic resin, and, in this case, the material cost of the insulation member can be reduced to one-half or less than the cost of a metal material, thereby the parts cost can be reduced by the reduction of the material cost. Further since the insulation member of the synthetic resin can be easily blanked, the durability of a metal mold can be improved. In the supply of parts, since the metal material was used conventionally, a hoop material was blanked in a press factory and blanked parts were transported. However, since the insulation member is composed of the synthetic resin, it can be blanked by a press machine installed on a movement assembly line. As a result, a hard job for transporting a hoop material is made unnecessary as well as it is not necessary to prepare a stock yard in a press factory and in an assembly factory, thereby job environment and work environment can be improved.

In the present invention, it is preferable that the insulation member flatly covers approximately the overall surface of the base frame confronting the time-display member.

According to this invention, since the approximately the overall surface of the base frame on the time-display member side thereof is covered with the insulation member, the good-looking outside appearance of a movement that is uniformly arranged by the same material can be obtained.

Further, since approximately the entire surface of the base frame is covered with the insulation member, the invasion of dusts and fluffs into the inside of the movement, in particular, into a train wheel portion can be prevented, thereby the stop and delay of hands, which are the fatal injury of a timepiece can be prevented and the quality of the timepiece can be improved.

In the present invention, it is preferable that a metal layer be formed on one surface of the insulation member that confronts the time-display member side.

According to this invention, there is an advantage approximately the same as a conventional case in which an insulation sheet and an hour wheel presser are provided separately, that is, an advantage that electric short-circuit between the power supply negative terminal and a dial plate, and the like can be prevented and that the outside appearance of a good-looking movement using a metal color as a base color can be obtained by making best use of the different characteristics of the insulation member and the metal layer.

At this time, the metal layer of the insulation member may be formed by dry plating applied to the one surface of the insulation member or may be formed of a metal foil bonded to the one surface of the insulation member.

An aluminum foil, a gold foil, and the like can be used as the metal foil.

Vapor deposition and ion plating can be applied as the dry plating, and any arbitrary metal such as stainless steel, copper, copper alloy, gold, gold alloy, nickel, nickel alloy, silver alloy, chromium, chromium alloy, etc. may be used as the metal layer, in addition to aluminum.

Note that which of the vapor deposition, ion plating, boding of metal foil is to be employed may be determined in consideration of the characteristics of these metals.

In the present invention, it is preferable that the insulation member be fixed to the base frame. In this case, it is preferable that the insulation member be fixed to the base frame by plastically deforming a plurality of portions such that the base frame comes into intimate contact with the insulation member. Further, it is preferable that the plastic deformation processing be a thermally activated deformation processing or a force impact processing.

According to this invention, since the insulation member is fixed to the base frame, it is neither dislocated nor removed by vibration, and the like. As a result, electric short-circuit occurred by the contact of the power supply negative terminal, and the like with the dial plate, and the like can be reliably prevented.

Further, when the insulation member is fixed by the plastic processing, in particular, by the thermally activated deformation or by force impact deformation, it is reliably fixed. The insulation member is firmly fixed when it is fixed by deforming protrusions from the base frame, thereby the hour wheel can be accurately fixed at a predetermined position. Further, since the insulation member is fixed by the plastic deformation processing, a drawback caused when it is fixed by a conventional hour wheel presser can be overcome. As a result, a cycle time can be shortened in an assembly process. Further, when the insulation member is fixed by the deforming a screw pin through force impact, a movement can be disassembled and parts can be replaced, thereby after service can be improved.

In the present invention, it is preferable that the insulation member be fixed to the base frame using an ultrasonic wave.

According to this invention, since the insulation member is fixed by the ultrasonic wave, it is prevented from being dislocated or replaced by the vibration, and the like from the outside of a timepiece body, thereby electric short-circuit can be reliably prevented.

In the present invention, it is preferable that the insulation member have an insertion hole defined therethrough to cause the leg of the time-display member to be inserted thereinto.

According to this invention, when a dial plate having a leg is provided, it is sufficient to insert the leg into the insertion hole, which permits the dial plate to be attached easily.

In the present invention, it is preferable that the time-display wheel be positioned in the axial direction by the insulation member.

According to this invention, since the time-display hour wheel can be reliably positioned, the play thereof can be optimized.

In the present invention, the electronic timepiece may be a multi-function timepiece having an auxiliary display portion different from the main display portion of the time-display member.

According to this invention, when another display wheel is particularly provided in correspondence to the auxiliary display portion, this another display wheel can be also reliably guided in the axial direction by the insulation member. Note that, when the main display portion is exclusively used to display a time, the auxiliary display portion may be used to display an alarm set time, chronograph, atmospheric pressure, water pressure, temperature, and the like. Further, when the hands in the main display portion are an hour hand and a minute hand, the auxiliary display portion may be used to display a second.

In the present invention, a solar cell panel containing solar cells may be disposed on one surface of the insulation member.

According to this invention, electric short-circuit between an electrode of the solar cell and metal parts (conductive parts) constituting a movement can be reliably prevented and further the time-display wheel such as the hour wheel can be reliably guided in the axial direction by the substrate film of the solar cell panel acting as the insulation member.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts.

FIG. 1 is a plan view showing a first embodiment of an electronic timepiece according to the present invention.

FIG. 2 is a longitudinal sectional view showing a structure of an insulation member of the first embodiment.

FIG. 3 is a sectional view taken along the line A—A of FIG. 1.

FIG. 4 is a sectional view taken along the line B—B of FIG. 1.

FIG. 5 is a plan view showing a second embodiment of the present invention.

FIG. 6 is a plan view showing a third embodiment of the present invention.

FIG. 7 is a longitudinal sectional view showing a main portion of the third embodiment.

FIG. 8 is a longitudinal sectional view a main portion a fourth embodiment of the present invention.

FIG. 9 is an outside appearance view showing a fifth embodiment of the present invention.

FIG. 10 is a longitudinal sectional view showing the fifth embodiment.

FIG. 11 is a longitudinal sectional view showing a sixth embodiment of the present invention.

FIG. 12 is a plan view showing constitutional members of the sixth embodiment.

FIG. 13 is longitudinal sectional views of the constitutional members, wherein a left side view is a sectional view taken along the line C—C of FIG. 12, a right side view is a sectional view taken along the line D—D of FIG. 12.

FIG. 14 is a longitudinal sectional view showing a structure of an insulation member according to a modification of the present invention.

DESCRIPTION OF THE PREFERRED EMBODIMENTS

Embodiments of the present invention will be described below based on the drawings.

FIGS. 1 to 4 show an electronic timepiece of a first embodiment.

An insulation sheet 12 (FIGS. 1–4) acting as an insulation member in electronic timepiece 1 prevents an electric short-circuit between an electrode (such as the negative power rail terminal 14 (FIGS. 1 and 3) in contact with a pole of the power supply (15 FIGS. 1 and 3)) and a member (such as dial plate 13 (FIGS. 2–4) composed of, for example, metal or some other electrically conductive material) tied to a ground potential. Dial plate 13 includes guides for an hour wheel 11 (FIGS. 1 and 4). To mitigate the effects of an electric short-circuit, the negative pole 15A (FIG. 3) of power supply 15 (which acts as a power source) provides the driving supply voltage for a driving-controlled circuit 36 (FIG. 1). The other side of the power supply 15, i.e. the positive pole 15B (FIG. 3), functions as a reference ground and is coupled to dial plate 13, or the like. Further, the positive pole 15B of power supply 15, which is at least partly held in place by a circuit presser sheet 19 (FIGS. 3 and 4) provides a positive pole voltage to a drive-IC 34.

Synthetic resins (such as polyester, polycarbonate, polyimide, etc.) and ceramics (such as alumina, etc.) or other insulative materials may be used as insulation sheet 12.

The electronic timepiece 1, arranged as described above, includes a main plate 10 (FIGS. 1–4) acting as a base frame in an approximately oval shape and formed of a synthetic resin material.

With reference to FIG. 4, an hour-wheel-accommodating recess 10A is formed at the center of the back surface of the main plate 10, which further includes a plurality of thermally-activated protrusions 10B/10C at a plurality of positions (four positions in present embodiment) for mating with hole-openings 12A and thereby attaching insulation sheet 12, and for securing insulation sheet 12 in place after thermal activation of initial protrusions 10B.

While in the present embodiment, the main plate 10 is formed in an approximately oval shape, the shape and size of main plate 10 is not crucial to the invention and may be modified as necessary. Furthermore, any of polycarbonate, polyacetal, polypropylene, polyphenylene sulfide, etc. are preferably used as the material for main plate 10. These materials have excellent mechanical strength, can be colored freely, and have excellent molding properties that permit them to be formed in a complex three-dimensional shape.

FIGS. 2 and 3 show protrusions 10B prior to thermal activation, and resultant protrusions 10C after thermal activation. Before protrusions 10B are plastically deformed in a thermal activation process, they project from the back surface of the main plate 10 and the projections are slightly longer than the desired, target distance between main plate 10 and dial plate 13. When attached to main plate 10, dial plate 13 serves as a time display member.

With reference to FIG. 2, the dotted lines represent the shape of protrusions 10B prior to thermal-activated deformation. Although they are shown penetrating into dial plate 13, this is not the case and is shown thusly purely to illustrate that the length of initial protrusions 10B prior to deformation is longer than the length of resultant protrusions 10C after deformation. The length of initial protrusions 10B is longer than the target distance desired after deformation. As explained above, initial protrusion are inserted in hold-openings 12A in insulation plate 12 so as to attach insulation plate 12 to main plate 10. The main plate 10 is then brought into contact with dial plate 13 and a thermal deformation process causes initial protrusions 10B to be plastically deformed outward between insulation plate 12 and dial plate 13 to form resultant protrusions 10C. As shown, the shape of resultant protrusions 10C form anchoring slits that secure insulation plate 12 in place.

As shown in FIGS. 1 and 4, the hour wheel 11 acting as the time-display wheel is accommodated in the hour-wheel-accommodating recess 10A, the outer periphery of the wheel portion of the hour wheel 11 is arranged as an hour hand attachment portion 11A, and an hour hand (not shown) is attached thereto. Further, the hour wheel 11 is guided by the insulation sheet 12 interposed between the back surface of the main plate 10 and the dial plate 13 and positioned in an axial direction thereby.

As shown in FIG. 1, the insulation sheet 12 is formed in an approximately rectangular shape and fixed in place while flatly covering the vicinity of the power supply 15 and the hour wheel 11. Further, as shown in FIG. 2, a metal layer 12C is formed on the surface of the insulation sheet 12 that faces dial plate 13. Furthermore, the plurality of hole-openings 12A, which are formed in insulation sheet 12, are located at positions corresponding to the plurality of thermally-activated, initial protrusions 10B.

In this embodiment, the metal layer 12C is formed by vapor deposition of a thin aluminum film on one side of insulation sheet 12, or by dry plating to which ion plating is applied, or some other known process. In addition to the above, an arbitrary metal film of stainless steel, copper, copper alloy, gold, gold alloy, nickel, nickel alloy, silver alloy, chromium, chromium alloy, etc. may be used as the metal layer 12C. Among them, the stainless steel film exhibits a magnetic resistant effect when it is flatly laid on a stepping motor 33 (FIG. 1), thereby reducing magnetic noise and mitigating a malfunction of drive-IC 34 (FIG. 1).

The insulation sheet 12 is attached in such a manner that the metal layer 12C faces toward the dial plate 13 side, hole-openings 12A are mated with initial protrusions 10B, heat is applied to the extreme ends of initial protrusions 10B using a jig or similar device (not shown), and the initial protrusions 10B are positioned such that the extreme ends are deformed outward between main plate 10 and dial plate 13, and the diameter at the end of the resultant protrusions 10C (after thermally-activated plastic deformation) is larger than at least the diameter of hole-openings 12A of the insulation sheet 12, whereby insulation sheet 12 is fixed to the main plate 10.

In the present embodiment, the plurality of initial protrusions 10B and corresponding hole-openings 12A are disposed at four positions in total so that they are disposed in a balanced manner. That is, they are disposed at three positions in the vicinity of the hour wheel 11 and at one position in the vicinity of the negative power rail terminal 14, which is the electrode in contact with the negative pole of power supply 15.

As a result, the gap between the main plate 10 and the insulation sheet 12 and the gap between the hour wheel 11 in hour-wheel-accommodating recess 10A and the insulation sheet 12 are minimized by their well-balanced positioning.

As shown in FIG. 4, an hour-wheel-escape hole 12D is defined at the portion of the insulation sheet 12 that corresponds to the hour hand attachment portion 11A of the hour wheel 11. Hour hand attachment portion 11A passes through hour-wheel-escape hole 12D. Hour-wheel-escape hole 12D is formed to have the minimum diameter that can pass hour hand attachment portion 11A therethrough. With this arrangement, the area of the insulation sheet 12 for guiding hour wheel 11 is increased as much as possible to thereby minimize the play of the hour wheel 11.

As shown in FIGS. 1 and 3, a guide slit 10D for attaching the negative power rail terminal 14 and a positioning hole 10E for positioning the negative power rail terminal 14 are formed at predetermined positions within main plate 10 that are covered with by insulation sheet 12 on the back surface of main plate 10. The negative power rail terminal 14 is formed of a slender spring material forming a thin sheet in its entirety. A fixing hole 14C formed at the base end side of terminal 14 is fitted on guide slit 10D, and a bent end of terminal 14 is inserted into positioning hole 10E. With this arrangement, the negative power rail terminal 14 is attached to the main plate 10 through the guide slit 10D.

The guide slit 10D is made hollow, and a metal screw pin 16 is force fitted into the hollow portion. A screw 17 is screwed into an inner thread portion of screw pin 16. Then, a circuit receiver 19 is fixed in place by the screw 17. It is preferable that the screw 17 be composed of metal to prevent the thermal deformation thereof, and it is more preferable that the screw 17 be a self-tapping screw.

A rounded projection 14A is disposed at an extreme end of the negative power rail terminal 14 so as to come into contact with the negative pole side 15A of power supply 15.

Further, the extreme end side of the negative power rail terminal 14 has a tongue-shaped sheet spring portion 14B located in an approximately oval spring hole 10G formed on the bottom of a power-supply-accommodation recess 10F that is formed on the main plate 10. Accordingly, the thickness of the negative power rail terminal 14 is not necessary between main plate 10 and insulation sheet 12. As a result, the overall thickness of a power supply portion of the structure is reduced.

The power-supply-accommodation recess 10F is formed on the front surface of the main plate 10 in the vicinity of the projection 14A side of the negative power rail terminal 14, which is partly covered with the insulation sheet 12. Power supply 15 is located in the power-supply-accommodation recess 10F.

The power supply 15 is situated with the negative pole side 15A facing the negative power rail terminal 14, and power flow is obtained by the contact of projection 14A at the extreme end of the negative power rail terminal 14 with the negative pole side 15A of power supply 15. Further, the power supply 15 is pushed upward by the tongue-shaped sheet spring portion 14B of the negative power rail terminal 14 at all times to thereby cause the projection 14A to be in contact with the negative pole side 15A of power supply 15 at all times, which prevents the interruption of operation of the hands due to shock from a drop, vibration and the like.

Returning to FIG. 1, the drive circuit 36, which includes a quartz crystal unit 35 and drive-IC 34, is situated on main plate 10 in the vicinity of hour wheel 11. Additionally, a drive conversion member (stepping motor) 33 for receiving drive signals from drive circuit 36 and for converting the drive signals into rotational motion is disposed in the vicinity of hour wheel 11.

As shown in FIGS. 1 and 4, a train wheel for transmitting the rotational motion from stepping motor 33 to gears and the like, such as hour wheel 11 to which a time-display hand is attached, is disposed on main plate 10. This train wheel preferably includes a rotor 44 disposed in communication with a stator 45 of stepping motor 33, a fifth wheel 43, a second wheel 42, a third wheel 41, a center wheel 40, a minute wheel 18, and hour wheel 11.

Rotor 44, fifth wheel 43, second wheel 42, and third wheel 41 are supported by main plate 10 and a train wheel bridge (shown in FIF. 4).

The train wheel bridge is preferably constructed of Polycarbonate, polyacetal, polypropylene, polyphenylene sulfide, etc. These materials are excellent in mechanical strength, can be colored freely, and can further be formed in a complex three-dimensional shape because they have an excellent molding property.

According to the first embodiment arranged as described above, the following advantages can be obtained.

(1) The vicinity of the negative power rail terminal 14 is covered with insulation sheet 12, and the hour wheel 11 is positioned in the axial direction when the shaft thereof is passed through the hour-wheel-escape hole 12D. Therefore, when insulation sheet 12 is assembled, it can be attached only by the insertion thereof into the shaft of the hour wheel 11, thereby simplifying the assembly thereof.

(2) The insulation sheet 12 has a size covering at least from the vicinity of the negative power rail terminal 14 to the hour wheel 11. Since the hour wheel 11 is positioned in the axial direction through insulation sheet 12, there is no possibility that insulation sheet 12 will become dislocated or removed in the vicinity of the negative power rail terminal 14. As a result, electrical short-circuits can be prevented and insulation can be reliably performed.

(3) Insulation sheet 12 has is made of a minimum size sufficient for covering at least from the vicinity of the negative power rail terminal 14 to the hour wheel 11, parts cost can thereby be reduced by a decrease in a material cost and the structure of a press metal mold can be simplified.

(4) Since insulation sheet 12 prevents a short-circuit between the negative power rail terminal 14 and the dial plate 13, and since insulation sheet 12 further functions as a guild for the hour wheel 11, which is positioned in an axial direction through insulation sheet 12, an insulating function and a guiding can be performed by only a single sheet, i.e. by insulation sheet 12. Thus, the number of parts can be reduced and cost can be reduced as well as the assembly job can be simplified and a cycle time in an assembly line can be reduced, as compared with the conventional art.

(5) Since the insulation sheet 12 is composed of the synthetic resin, the material cost can be reduced by at least half as compared to the cost of a metal material. Therefor, the overall parts cost can be reduced by the reduction of a material cost.

(6) Since the insulation sheet 12 is composed of the synthetic resin, it can be easily punched out from a base material during its construction. Thus, the durability of a metal mold used in the construction of insulation sheet 12 is improved. Conventionally, such parts are punched out into a hoop shape at a press factory and then transported to an assembly factory as part supplies. By contrast in the present invention because of its synthetic resin construction, insulation sheet 12 can be punched out by a press installed on a movement assembly line. Therefore the hard job transporting hoop material is unnecessary, nor is it necessary to prepare a stock yard in a press factory and in an assembly factory, and the job environment and work environment can thereby be improved.

(7) Metal layer 12C is formed on one side of insulation sheet 12, and insulation sheet 12 is positioned with metal layer 12C facing the dial plate 13 side. Accordingly, substantially the same advantage as that of the conventional case in which an insulation sheet and a separate hour wheel presser sheet are used. By making good use of the different characteristics of insulation sheet 12 and its metal layer 12C, the present the present invention achieves the advantage of excellent electrical insulation between the power supply negative terminal 14 and the dial plate 13, and the advantage of a good outside appearance for the movement.

(8) The tongue-shaped sheet spring portion 14B at the extreme end side of negative power rail terminal 14 is located in the approximately oval spring hole 10G formed on the bottom of the power-supply-accommodation recess 10F of main plate 10. Thus, it is not necessary to provide a additional space to accommodate the thickness of the negative power rail terminal 14 between main plate 10 and insulation sheet 12. As a result, it is possible to reduce the thickness of the timepiece movement in the area of the power supply, whereby the overall thickness of the timepiece can be reduced.

(9) The hour wheel escape hole 12D formed through the insulation sheet 12 is set to a minimum diameter through which the hour hand attachment portion 11A can be passed, which increases the area of the insulation sheet 12 where the hour wheel 11 is guided. Accordingly, the hour wheel 11 can be positioned reliably as well as the play of the hour wheel 11 can be minimized.

(10) The insulation sheet 12 can be reliably fixed to main plate 10 because it is fixed thereto by the thermally-activated, plastically deformed protrusions. As a result, an electric short-circuit between the negative power rail terminal 14 and the dial plate 13 can be reliably prevented because the insulation sheet 12 can neither dislocated nor removed even by vibration, and the like. Further, since the hour wheel can be reliably positioned, the play of the hour wheel 11 can be optimized.

Next, a second embodiment of the present invention will be described based on FIG. 5.

In the present second embodiment, the entire timepiece movement is covered with an insulation sheet, whereas by contrast in the first embodiment, only the vicinity of the power supply 15 and the hour wheel 11 is flatly covered by insulation sheet 12. Elements in the present second embodiment similar to those of the first embodiment are identified by similar reference characters, and are described above.

In the present second embodiment, an insulation sheet 22 acting as an insulation member covers approximately the overall surface of main plate 10 on the side facing dial plate 13, except for a portion corresponding to the periphery of the hour-hand-attachment portion 11A of a hour wheel 11, portions corresponding to insertion holes 10H necessary to assemble leg inserting portions of dial plate 13, and the like, and portions corresponding to initial protrusions 10B. Accordingly, the initial protrusions 10B are position on main plate 10 at seven locations, that is, at four locations in the vicinity of the peripheral edge of insulation sheet 22 and at three locations around the hour wheel 11, equally spaced from each other. Further, a metal layer 12C is formed on the surface of the insulation sheet 22 on the dial plate 13 side thereof, as shown in FIG. 2.

According to the second embodiment arranged as described above, the following advantages can be obtained, in addition to advantages similar to the above items (1) to (10) except for items (2) and (3).

(11) Since the movement is covered with the insulation sheet 22 in its entirety, a good outside appearance is more improved as well as the invasion of dusts and fluffs into the inside of the movement, in particular, into a train wheel portion can be prevented, thereby the stop and delay of hands, which are the fatal injury of a timepiece can be prevented, and the quality of the timepiece can be improved.

Next, a third embodiment of the present invention will be described based on FIGS. 6 and 7.

In the third embodiment, an insulation sheet fixed in position pins plastically deformed through force, as opposed to the first and second embodiments where the insulation sheet is fixed by the thermally, activated, plastic deformation of protrusions from main plate 10. Note that the insulation sheet 22 covers the timepiece movement in its entirety in a manner similar to that of the second embodiment. Also in this third embodiment, the same reference numerals as used in the above respective embodiments are used to denote the same parts, the description of the same parts is simplified, and only different portions will be described.

As shown in FIG. 7, insulation sheet 22 is fixed to the back surface of a main plate 10 by deformations in screw pins 23. Screw pins 23 are first inserted into main plate 10, and insulation sheet 22 is then placed on screw pins 23. A chisel is then used to hit into the exposed base of screw pins 23 through the hole-openings of insulation sheet 22. The impact of the chisel forms a chiseled hole 23A that causes an outward deformation forming pint anchors 23B on the base of screw pin 23. The pin anchors 23B secure insulation sheet 22 in place. In other word, the chiseled holes 23A are formed along the axial center on the planar surfaces of screw pins 23, which will face dial plate 13. The force of the impact in forming chiseled holes 23A widens the outer periphery of the base resulting in an outward deformations that creates pin anchors 23B. These pin anchors 23B are formed at three approximately equidistant positions in the vicinity of insulation sheet 22.

Further, it is preferable to use a chisel having an impact tip as near to a conical shape as possible, such as an octagonal shape, because the radial force can be increased thereby.

Further, in using pins, the screw pins can be reused by disassembling them, and re-impacting the upper portions of the screw pins 23 with a chisel again after the part is replaced.

According to the third embodiment arranged as described above, the following advantages can be obtained, in addition to advantages similar to the above items (1) to (11) except the items (2), (3), and (10).

(12) Since a heat source for thermal-active deformation is not necessary, the structure of an apparatus can be simplified.

Further, in using pins, the screw pins 23 can be reused by disassembling them, and re-impacting the upper portions of the screw pins 23 with a chisel again after a part is replaced. Therefore, a movement can be disassembled, which permits the replacement of a part to thereby improve the after purchase, service.

Next, a fourth embodiment of the present invention will be described based on FIG. 8.

In the fourth embodiment, emboss processing 32A is applied to a part of an insulation sheet 32 acting as an insulation member. The insulation sheet 32 of this embodiment can be used to cover a part of the quartz crystal unit 35 and the stepping motor 33 in the first embodiment by partly extending the insulation sheet 12, in addition to that, it is applied to the case in which a movement is covered by the insulation sheet 32 in its entirety, similarly to the insulation sheet 22 of the second and third embodiments.

The emboss processing 32A is applied to the part of the insulation sheet 32 as described above, and the surface thereof is formed in an irregular shape. The irregular portion having been subjected to the emboss processing 32A corresponds to a part of a quartz crystal unit 35 supported by a circuit receiver 19 and can be used as a cushion member for the quartz crystal unit 35 (including a quartz oscillator), which can prevent the breakage of the quartz oscillator due to a shock from the outside such as a drop, and the like.

Note that the insulation sheet 32 also has a structure similarly to that of the insulation sheets 12 and 22, as shown in FIG. 2.

According to the fourth embodiment arranged as described above, the following advantages can be obtained, in addition to advantages similar to the above items (1) to (12) except the items (2) and (3).

(13) Since the insulation sheet 32 can be used as a shock absorption member of the quartz crystal unit 35 (including the quartz oscillator), the breakage of the quartz oscillator due to a shock from the outside such as drop, and the like, can be prevented.

Next, a fifth embodiment of the present invention will be described based on FIGS. 9 and 10.

An electronic timepiece 50 of this embodiment is a multi-function timepiece having functions such as an alarm function, a chronograph, and the like. Accordingly, a dial plate 13 includes a main display portion 52 having an ordinary time-display scale 51 and an auxiliary display portion 54 having a scale 53 for displaying an alarm set time. In the main display portion 52, an hours hand 55, a minutes hand 56, and a seconds hand 57 point to the scale 51, whereas, in the auxiliary display portion 54, an alarm hours hand 58 and an alarm minutes hand 59 point to the scale 53. Note that a chronograph hour and minute may be displayed on the auxiliary display portion 54 and further times of various locations in the world may be displayed thereon, in addition to the alarm set time.

While the alarm function is not described in detail, the alarm hours hand 58 and the alarm minutes hand 59 are attached to an alarm hour wheel 61 and an alarm minute wheel 62, respectively. The alarm minute wheel 62 is driven by a stepper motor, not shown, through an alarm intermediate wheel 63, and the drive force of the unlocking minute wheel 62 is transmitted to the alarm hour wheel 61 through an alarm wheel 64. However, in this embodiment, the stepper motor is provided separately from a stepper motor for driving the hours hand 55, the minutes hand 56, and the seconds hand 57. Accordingly, it is possible for the auxiliary display portion 54 to also display an ordinary time using the independent stepper motor, in manner similar to the main display portion 52.

In the electronic timepiece 50 arranged as described above, an insulation sheet 72 is interposed between a main plate 10 and a dial plate 13, an alarm-hour-wheel-escape hole 72E is defined through insulation sheet 72, in addition to an alarm-hour-wheel-escape wheel 72D. Then, an hour wheel 11 and an alarm hour wheel 61 are guided in an axial direction by the peripheral edge portions of these escape holes.

According to the fifth embodiment arranged as described above, the following advantage can be obtained by the specific arrangement thereof.

(14) While the alarm hour wheel 61 is interposed between the main plate 10 and the dial plate 13 in the electronic timepiece 50, the alarm hour wheel 61 can be also guided in the axial direction by the insulation sheet 72, thereby facilitating the assembling of this portion of the timepiece, reducing the cost of the timepiece movement, and other benefits can be realized.

Subsequently, a sixth embodiment will be described based on FIGS. 11, 12, and 13.

An electronic timepiece 80 in accord with the present sixth embodiment is arranged such that a stepper motor is driven by electrical power generated by a solar cell. In the present embodiment, a dial plate 13 has light transmittance properties, and a solar cell panel 81 is disposed on the back surface side (upper side in FIG. 11) of dial plate 13. The dial plate 13 and solar cell panel 81 are clamped between a casing ring 80A (the peripheral edge of which is composed of a synthetic resin) and a metal panel cover 80B. A main plate 10, not shown and include within the timepiece movement (FIG. 11), is disposed on the back surface side of solar cell panel 81 so as to clamp an hour wheel 11. It is preferable that solar cell panel 81 be bonded on the movement by a tape, or the like.

In FIGS. 12 and 13, solar cell panel 81 includes four quarter-circular solar cells 84 (which function as a power supply) on a substrate film 83 (which serves as an insulting member). The visible part of substrate film 83 is shown forms a cross-shape on the light receiving side-surface of solar cells 84 in the boundary portions thereof. The directions of the four arms of the cross-shape point to the four directions of 12 o'clock, 3 o'clock, 6 o'clock, and 9 o'clock, respectively. As a result, in this embodiment, the position of a pointer, such as the minutes hand, can be understood based on the visible cross-shape of substrate film 83, even if a scale is not formed on dial plate 13.

Solar cells 84 are preferably composed of a laminated structure having a negative electrode layer 85 as an electrode formed on the flexible substrate film 83 (such as plyimide), a power generation layer 86 composed of amorphous silicon (or silicon mono-crystal) formed on the negative electrode layer 85, a first insulation resin layer 87 formed on the power generation layer 86 along its outer peripheral side, a positive electrode layer 88 covering the power generation layer 86 on the center side (center side of the solar cell panel 81) thereof and covering the first insulation resin layer 87, and a second insulation resin layer 89 formed on the positive electrode layer 88 on the outer periphery side thereof. Further, the light receiving surface sides of the solar cells 84 are sealed by a seal resin agent 91. The seal resin agent 91 and the positive electrode layer 88 are composed of a material having light transmittance properties because they must pass light therethrough to the power generation layer 86. Note that the seal resin agent 91 and the positive electrode layer 88 are not shown in FIG. 12.

In this structure, in, for example, a solar cell 84A shown in FIG. 12, an arc-shaped slender wiring electrode layer 92 is formed around the inner peripheral surface of the second insulation resin layer 89 on the transparent positive electrode layer 88 (refer to FIG. 13), and a part of the wiring electrode layer 92 is drawn out onto the second insulation resin layer 89 as a large width portion 921 and extends shortly to other adjacent solar cell 84 side. The wiring electrode layer 92 conducts to the positive electrode layer 88 at the slender arc-shaped portion thereof (refer to FIG. 13), the shortly extending extreme end portion thereof passes through a through hole and conducts to the negative electrode layer 85 of a solar cell 84B. The adjacent solar cells 84A to 84D are electrically connected to each other in series in this manner.

Note that a sectional view on the left side of FIG. 13 is a sectional view taken along the line C—C of FIG. 12, wherein a wiring electrode layer 92A is further drawn out from the large width portion 921 having been drawn out onto the second insulation resin layer 89 to a back surface side and conducts to a positive terminal 93 on the back surface side. At this time, two arc-shaped, through holes are formed from the positive electrode layer 88 to the negative electrode layer 85 in the inside of a laminated body by laser processing, or the like, and filled with a resin for forming the second insulation resin layer 89. Accordingly, the wiring electrode layer 92A passes between the through holes in the laminated body so as to be completely insulated from the negative electrode layer 85.

In contrast, a sectional view on the right side of FIG. 13 is a sectional view taken along the line D—D of FIG. 12, wherein an isolated and remaining wiring electrode layer 92B is drawn out onto the back surface side and connected to a negative terminal 94 on the back surface side. At this time, the inner through hole of the two arc-shaped, through holes passes through only the positive electrode layer 88 and the first insulation resin layer 87 in the laminated body. Accordingly, the wiring electrode layer 92B is completely insulated from the positive electrode layer 88 and comes into contact only with the negative electrode layer 85, thereby conductivity is established between the negative terminal 94 and the negative electrode layer 85.

In the solar cell panel 81 as described above, the positive terminal 93 and the negative terminal 94 are connected to a not shown drive circuit, electric power generated is stored in an appropriate charge-storage means such as a capacitor, or the like, and a drive-IC and the stepper motor are driven by the stored electric power. Further, the respective terminals 93 and 94 are formed in a small dot shape, and the substrate film 83 faces the hour wheel 11 and the movement in a largest area. Then, as shown in FIG. 11, the hour wheel 11 is guided in an axial direction by the substrate film 83 (only the solar cell panel 81 is shown FIG. 11). That is, the substrate film 83 has both a role for preventing electric short-circuit between metal conductive parts constituting the movement and the hour wheel 11 and the negative electrode layer 85 and a role for guiding the hour wheel 11 in the axial direction, and acts an insulation member according to the present invention.

According to the sixth embodiment, the following advantage can be obtained by the specific arrangement thereof.

(15) The electronic timepiece 80 includes the solar cells 84 as a power supply. Even in such a case, however, since the hour wheel 11 is guided in the axial direction by the substrate film 83, the solar cells 84 side can be reliably insulted from other conductive parts as well as not requiring other parts to serve as a guide for hour wheel 11, thereby facilitating an assembly job and reducing cost.

It should be noted that the present invention is by no means limited to the above respective embodiments and they may be appropriately combined, and the following modifications may be employed so long as they can achieve the object of the present invention.

That is, in the first and second embodiments, the insulation sheet 12/22 is fixed to the main plate 10 by using thermally activated, plastic deformation of protrusions in main plate 10, and in the third embodiment the insulation sheet 22 is fixed to the main plate 10 using pins. However, the present invention is not limited to fixing in place the insulation sheet by a plastic deforming process. The insulation sheet may be fixed in place to main plate 10 by using an ultrasonic wave. The insulation sheet 12 can be fixed reliably when it is fixed by the ultrasonic wave. As a result, the insulation sheet 12 is neither dislocated nor removed by vibration, and the like, thereby electric short-circuit between the power supply negative terminal 14 and the dial plate 13 can be reliably prevented.

Further, in the first and second embodiments, the insulation sheet 12/22 is fixed to the main plate 10 by using thermally activated, plastic deformation of protrusions in main plate 10. However, the present invention is not limited thereto, and the insulation sheets 12 and 22 may be fixed to the main plate 10 by using pins, respectively in the first and second embodiments, in manner similar to that of the third embodiment.

Further, the number of protrusion 10B for fixing insulation sheets 12 and 22 to main plates 10 in the first and second embodiments, and the number of the screw pins 23 in the third embodiment are not limited to those in the exemplary number used in above described embodiments, and the numbers may be larger or smaller than those in the respective embodiments. It is preferred, however, that protrusion 10B and the screw pins 23 be disposed in a balanced manner.

Further, the metal layer 12C formed on insulation sheets 12, 22, and 32 may be formed of a metal foil that is bonded to insulation sheets 12, 22, and 32, or may be formed by vapor deposition of a thin aluminum film, or by dry plating using ion-plating, or the like. At this time, any arbitrary material may be used as the metal foil and may be appropriately selected and used from the metals described in the first embodiment.

Further, the insulation sheets 12, 22, and 32 of the respective embodiments are not limited to an insulation sheet on which the metal layer 12C is formed, and a single-layered insulation member composed of a polyester film, a synthetic resin, or the like may be used, as is shown in FIG. 14. Many types of sheets having various colors and surface treatment are available as the single-layered insulation member. Thus, a user, who does not desire an outside appearance of metal, can select a desired insulation member from various samples such as a white, red, and black sheets, a transparent sheet acting as a skeleton, a glossy sheet, a matte sheet, a sheet having surface processing such as hair line processing, and the like. Thus, a wide range of desires of the user can be satisfied thereby.

Further, when the insulation sheet is formed of the single-layered member, it is possible to use a printable metallic material to which surface processing of stripe patterns, and the like can be also applied by glossy and hair-line processing. Using this material dose not deteriorate the outside appearance of a movement, and a movement having an outside appearance that is not available conventionally can be obtained, in addition to that a movement whose outside appearance is as attractive as that of a conventional metal sheet can be obtained.

Further, when the insulation sheet is formed of the single-layered member, movements can be discriminated by changing the color of the material of the insulation sheet 12 depending upon a difference of hands and destinations or by a display for recognition made by pad printing, screen printing, and the like. Accordingly, a type of parts can be discriminated more easily than ever, which prevents parts having the same shape or a similar shape from being erroneously assembled.

The auxiliary display portion of the multi-function timepiece may display a chronograph, atmospheric pressure, water pressure, temperature, and the like, in addition to the alarm set time. The number of the auxiliary display portion is not limited to one, and a plurality of auxiliary display portions having a different display content may be provided.

Further, a primary cell that makes use of a chemical reaction and can be discharged only and cannot be charged, a silver oxide cell, a lithium cell, a secondary cell that makes use of a chemical reaction and can be charged and discharged repeatedly, a capacitor, a cell containing an electromagnetic power generation mechanism can be employed as the power supply.

Then, these modifications may be appropriately combined with the aforementioned embodiments.

ADVANTAGES OF THE INVENTION

As described above, according to the electronic timepiece of the present invention, there is an advantage that the same part can be used to insulate the power supply side from the other conductive parts, and to guide the time-display wheel, which facilitates an assembly job and reduces cost.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. An electronic timepiece comprising:

a base frame composed of a synthetic resin;

a power supply for providing electric power to a first power rail and a second power rail, said second power rail being a reference ground and being coupled to a covering plate;

a drive conversion unit rotatively driven by said electric power;

a drive-controlling circuit for controlling the rotation of said drive conversion unit, said drive controlling circuit having an power electrode directly coupled to said first power rail;

a time-display member on said base frame and visible from the outside of said electronic timepiece;

a time-display wheel rotated by said drive conversion unit and interposed between said base frame and said time-display member, said time-display wheel having a shaft functioning as its axis of rotation; and a planar insulation member for preventing a short-circuit between said first and second power rails, said planar insulation member being disposed between said power electrode and said covering plate, and having an area covering said power terminal and covering at least a portion of said time-display wheel, wherein said planer insulation member includes a guide hole through which said shaft is guided.

2. An electronic timepiece according to claim 1, wherein said planar insulation member substantially covers the overall surface of said base frame that faces said time-display member.

3. An electronic timepiece according to claim 1, wherein said planar insulation member further has a metal layer on its surface facing said time-display member.

4. An electronic timepiece according to claim 3, wherein said metal layer is formed by dry plating applied to the one surface of said planar insulation member.

5. An electronic timepiece according to claim 3, wherein said metal layer is formed of a metal foil bonded to one surface of said planar insulation member.

6. An electronic timepiece according to claim 1, wherein said planar insulation member is fixed to said base frame.

7. An electronic timepiece according to claim 6, wherein said insulation member is fixed to said base frame by a plurality of plastically deformed protrusions from said base frame, wherein said protrusions maintain said planar insulation member in intimate contact with said base frame.

8. An electronic timepiece according to claim 7, wherein said protrusions are mated to hole-openings in said base frame, and said protrusions are plastically deformed by at least one of thermal activation and force impact.

9. An electronic timepiece according to claim 6, wherein said planar insulation member is fixed to said base frame by ultrasonic waves.

10. An electronic timepiece according to claim 1, wherein said time-display member has a leg and said planar insulation member has an insertion hole through which said leg is inserted.

11. An electronic timepiece according to claim 1, said planar insulation member maintains the axial direction of said display wheel.

12. An electronic timepiece according to any of claims 1, wherein said time-display member has a main display, and said electronic timepiece is a multi-function timepiece having an auxiliary display different from said main display portion of said time-display member.

13. An electronic timepiece according to claim 1, wherein said power supply is a solar cell panel containing solar cells and disposed on one surface of said insulation member.

* * * * *